US007037084B2

(12) United States Patent
King

(10) Patent No.: US 7,037,084 B2
(45) Date of Patent: May 2, 2006

(54) BLOWER UNITS

(76) Inventor: Peter J. King, 31 Morning Glory Drive, Lake Cooroibah, OLD 4565 (AU)

( * ) Notice: Subject to any disclaimer, the term of this patent is extended or adjusted under 35 U.S.C. 154(b) by 0 days.

(21) Appl. No.: 10/807,055

(22) Filed: Mar. 18, 2004

(65) Prior Publication Data

US 2004/0191052 A1 Sep. 30, 2004

Related U.S. Application Data

(63) Continuation-in-part of application No. PCT/AU02/01440, filed on Oct. 24, 2002.

(51) Int. Cl.
*F04B 17/00* (2006.01)

(52) U.S. Cl. ..... 417/53; 417/368; 417/423.8

(58) Field of Classification Search ..... 417/368, 417/366, 371, 423.8, 423.14, 53
See application file for complete search history.

(56) References Cited

U.S. PATENT DOCUMENTS 4,088,424 A * 5/1978 Hyatt et al. ..... 417/368
4,518,325 A * 5/1985 Kingston ..... 417/368
4,978,281 A * 12/1990 Conger, IV ..... 417/423.15
5,156,535 A * 10/1992 Budris et al. ..... 417/423.7
6,037,684 A * 3/2000 DeYoung et al. ..... 310/58
6,155,802 A * 12/2000 Choi et al. ..... 417/366

FOREIGN PATENT DOCUMENTS

AU 599909 2/1990

* cited by examiner

*Primary Examiner*—Charles G. Freay
(74) *Attorney, Agent, or Firm*—Donald J. Ersler

(57) ABSTRACT

A blower unit includes a housing, a shroud, a motor, a feed air impeller, a fan casing and a cooling air impeller. A motor shaft extends from both ends of the motor. The feed air impeller is attached to a front of the motor and the cooling air impeller is attached to a rear of the motor. The feed air impeller is contained in the fan casing. The shroud retains the motor and forms a guide chamber around the fan casing. The shroud is retained in the housing. Air is drawn through a front of the housing by the cooling air impeller. The air flows between the motor and the shroud and out of a bottom of the housing. Air is drawn by the feed air impeller and forced through the plurality of apertures in the fan casing and through a housing outlet by the feed air impeller.

21 Claims, 12 Drawing Sheets

BLOWER UNITS

CROSS-REFERENCES TO RELATED APPLICATIONS

This is a continuation-in-part application taking priority from PCT patent application serial number PCT/AU02/01440 filed on Oct. 24, 2002.

BACKGROUND OF THE INVENTION

1. Field of the Invention

The present invention relates generally to blower units and more specifically to blower units of the type used with spa pools and baths which are commonly called spa blowers or spa bath blowers, and for illustrative purposes reference will be made to such application. Typically such units include a fan unit which is close coupled to an electric motor, with the fan impeller being directly mounted on the motor drive shaft and enclosed in a fan casing. It will be appreciated that the invention may have application in other fields where a vacuum supply is required and thus reference to the invention as a blower unit is not to be taken as restricting the invention to only that use.

2. Discussion of the Prior Art

Australian Patent No. 599,909 granted to the present applicant, describes a blower unit in which cooling air for the drive motor follows a different path from that of the feed air for the blower even though all air enters the unit housing through the same inlet ports. That arrangement overcomes, or at least ameliorates some of the problems associated with other blower units in which the blower draws feed air over or through the drive motor in order to cool the drive motor. As described in patent No. 599,909, reduction of the blower output through blockage or heavy load results in insufficient feed air being drawn over or through the drive motor and causes consequential overheating of the motor. Although the blower unit described in patent No. 599,909 has significant benefits over other blower units, it is not as compact as desired for some applications.

Accordingly, there is a clearly felt need in the art for a blower unit, which is sufficiently compact to satisfy at least some market requirements for more efficient compact blowers, has separate air flow paths for the drive motor, and has relatively low noise emission.

SUMMARY OF THE INVENTION

The present invention provides a blower unit, which includes relatively low noise emission. The blower unit includes a close coupled fan unit having an electric drive motor and a feed air impeller mounted on or directly connected to the motor shaft and a motor cooling impeller connected to the motor shaft, the feed air impeller having a feed air inlet and a feed air outlet and the motor cooling impeller having a cooling air inlet and a cooling air outlet and being arranged to force cooling air over or through the motor, the close coupled fan unit being supported in a shroud, the close coupled fan unit and the shroud cooperating to define a motor chamber and a fan chamber, the fan chamber having a feed air opening in fluid communication with the feed air inlet of the feed air impeller and a feed air outlet in fluid communication with the feed air outlet of the feed air impeller, and the motor chamber having a cooling air opening in fluid communication with the cooling air inlet of the motor cooling impeller and a cooling air outlet in fluid communication with the cooling air outlet of the cooling air impeller, the shroud being supported in a housing, the housing and the shroud defining therebetween a first chamber and a second chamber in fluid communication with the first chamber, the housing having a fresh air opening for passage of fresh air therethrough into the first chamber, a feed air discharge opening in fluid communication with the feed air outlet of the shroud for passage of feed air therethrough and a cooling air discharge opening in fluid communication with the motor chamber for passage of cooling air therethrough from the motor, the second chamber being in fluid communication with the feed air opening of the shroud and the first chamber, and one or both of the first and second chambers being in fluid communication with the cooling air opening of the shroud, the feed air discharge opening being arranged to discharge feed air in a direction substantially parallel to the axis of the motor shaft.

A second embodiment of the blower unit includes a close coupled fan unit having an electric drive motor and a feed air impeller mounted on or directly connected to the motor shaft and a motor cooling impeller connected to the motor shaft, the feed air impeller having a feed air inlet and a feed air outlet and the motor cooling impeller having a cooling air inlet and a cooling air outlet and being arranged to force cooling air over or through the motor, the close coupled fan unit being supported in a shroud, the close coupled fan unit and the shroud cooperating to define a motor chamber and a fan chamber, the fan chamber having a feed air opening in fluid communication with the feed air inlet of the feed air impeller and a feed air outlet in fluid communication with the feed air outlet of the feed air impeller, and the motor chamber having a cooling air opening in fluid communication with the cooling air inlet of the motor cooling impeller and a cooling air outlet in fluid communication with the cooling air outlet of the cooling air impeller, the shroud being supported in a housing, the housing and the shroud defining therebetween a first chamber and a second chamber in fluid communication with the first chamber, the housing having a fresh air opening for passage of fresh air therethrough into the first chamber, a feed air discharge opening in fluid communication with the feed air outlet of the shroud for passage of feed air therethrough and a cooling air discharge opening in fluid communication with the motor chamber for passage of cooling air therethrough from the motor, the second chamber being in fluid communication with the feed air opening of the shroud and the first chamber, and one or both of the first and second chambers being in fluid communication with the cooling air opening of the shroud, the feed air inlet of the close coupled fan unit being at one end of the motor shaft and the cooling air inlet being at the other end and the feed air opening of the fan chamber being adjacent the feed air inlet of the close coupled fan unit and the cooling air opening of the motor chamber being adjacent the cooling air inlet of the motor cooling impeller, the fresh air opening and the feed air discharge air opening in the housing being adjacent the feed air opening of the fan chamber and the first and second chambers being arranged such that fresh air passing through the fresh air opening and into the feed air inlet of the fan chamber flows firstly through the first chamber.

A third embodiment of a blower unit includes a close coupled fan unit having an electric drive motor and a feed air impeller mounted on or directly connected to the motor shaft and a motor cooling impeller connected to the motor shaft, the feed air impeller having a feed air inlet and a feed air outlet and the motor cooling impeller having a cooling air inlet and a cooling air outlet and being arranged to force cooling air over or through the motor, the close coupled fan unit being supported in a shroud, the close coupled fan unit and the shroud cooperating to define a motor chamber and a fan chamber, the fan chamber having a feed air opening in fluid communication with the feed air inlet of the feed air impeller and a feed air outlet in fluid communication with the feed air outlet of the feed air impeller, and the motor chamber having a cooling air opening in fluid communication with the cooling air inlet of the motor cooling impeller and a cooling air outlet in fluid communication with the cooling air outlet of the cooling air impeller, the shroud being supported in a housing, the housing and the shroud defining therebetween a first chamber and a second chamber in fluid communication with the first chamber, the housing having a fresh air opening for passage of fresh air therethrough into the first chamber, a feed air discharge opening in fluid communication with the feed air outlet of the shroud for passage of feed air therethrough and a cooling air discharge opening in fluid communication with the motor chamber for passage of cooling air therethrough from the motor, the second chamber being in fluid communication with the feed air opening of the shroud and the first chamber, and one or both of the first and second chambers being in fluid communication with the cooling air opening of the shroud, the feed air inlet of the close coupled fan unit being at one end of the motor shaft and the cooling air inlet being at the other end and the feed air opening of the fan chamber being adjacent the feed air inlet of the close coupled fan unit and the cooling air opening of the motor chamber being adjacent the cooling air inlet of the motor cooling impeller, the fresh air opening and the feed air discharge air opening in the housing being adjacent the feed air opening of the fan chamber, and the second chamber being in fluid communication with the first chamber via a connecting passage adjacent the motor cooling fan inlet and the motor cooling fan inlet is in fluid communication with the connecting passage.

Preferably, the close coupled fan unit has a fan casing about the feed impeller with a feed air inlet opening and a feed air outlet opening and the shroud is adapted to encapsulate the fan casing with the feed air inlet of the shroud cooperating with the feed air inlet of the casing to guide fresh air into the feed air impeller.

Although the close coupled fan unit has been described as having a motor cooling impeller on the motor shaft since that is the typical arrangement in the type presently available, it will be appreciated that a cooling fan separate from the fan unit drive motor could be provided and arranged to force air over or through the motor housing.

In a preferred form the shroud has a lower shroud half and an upper shroud half which together define a generally cylindrical chamber which is adapted to provide a streamlined flow path for inflowing feed air and motor cooling air. In one preferred form each of the shroud halves terminates in an outwardly extending flange which is adapted to engage with the housing to separate it into the first and second chambers. Advantageously, in such form, the housing includes a first housing half and a complementary second housing half adapted to be sealingly connected to the first housing half, and the shroud engages within the housing halves by simply sliding each housing half over the shroud from opposite ends thereby allowing quick and easy assembly.

Accordingly, it is an object of the present invention to provide a blower unit, which has separate air flow paths for the drive motor.

It is a further object of the present invention to provide a blower unit, which is sufficiently compact to satisfy at least some market requirements for more efficient compact blowers.

Finally, it is another object of the present invention to provide a blower unit, which has relatively low noise emission.

These and additional objects, advantages, features and benefits of the present invention will become apparent from the following specification.

BRIEF DESCRIPTION OF THE DRAWINGS

In order that the invention may be more clearly understood and put into practical effect, the invention will now be described with reference to the accompanying drawings wherein.

DETAILED DESCRIPTION OF THE PREFERRED EMBODIMENTS

Figure 1:
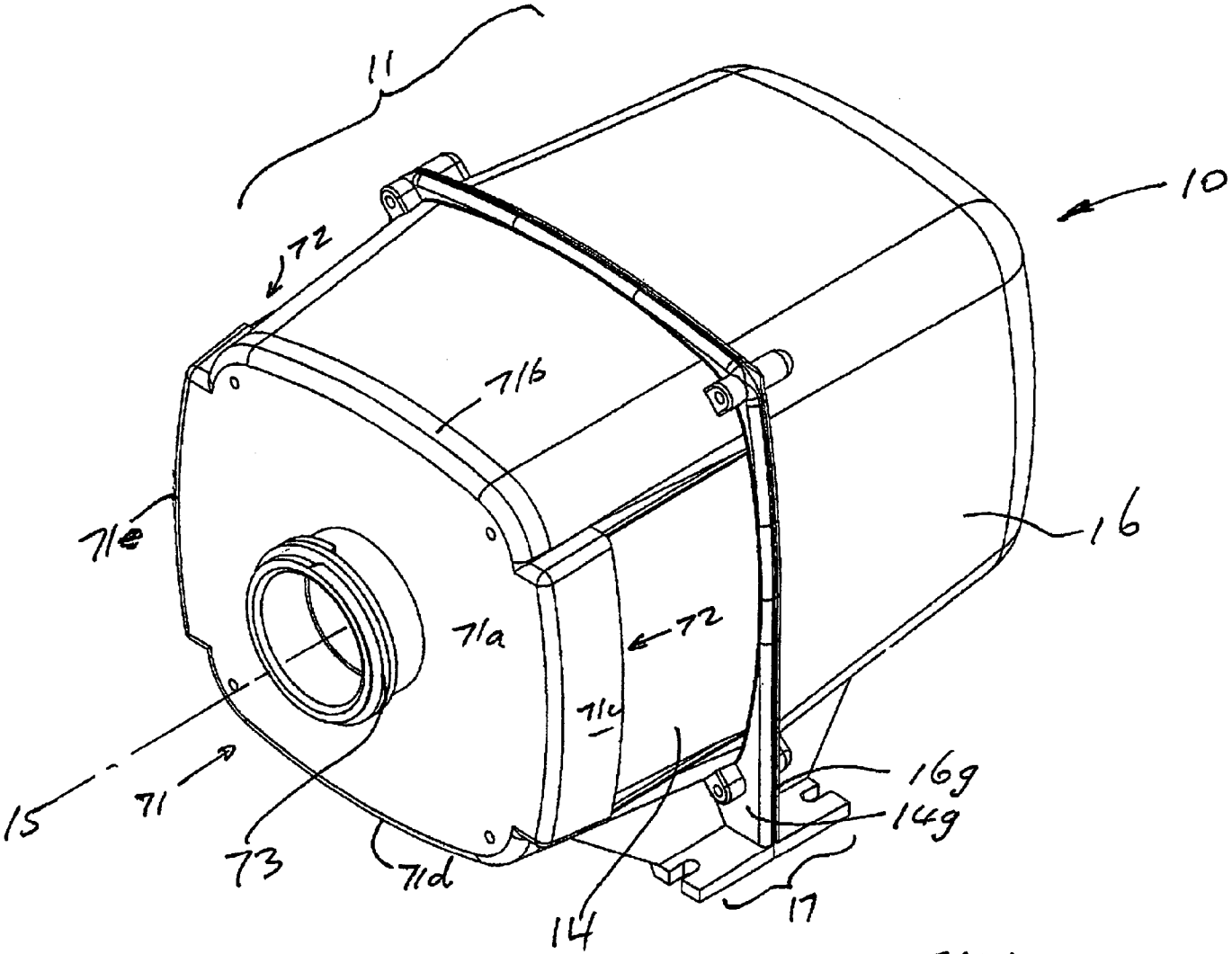
FIG. 1 is an isometric view of a blower unit according to the present invention including an end cover.
Figure 2:
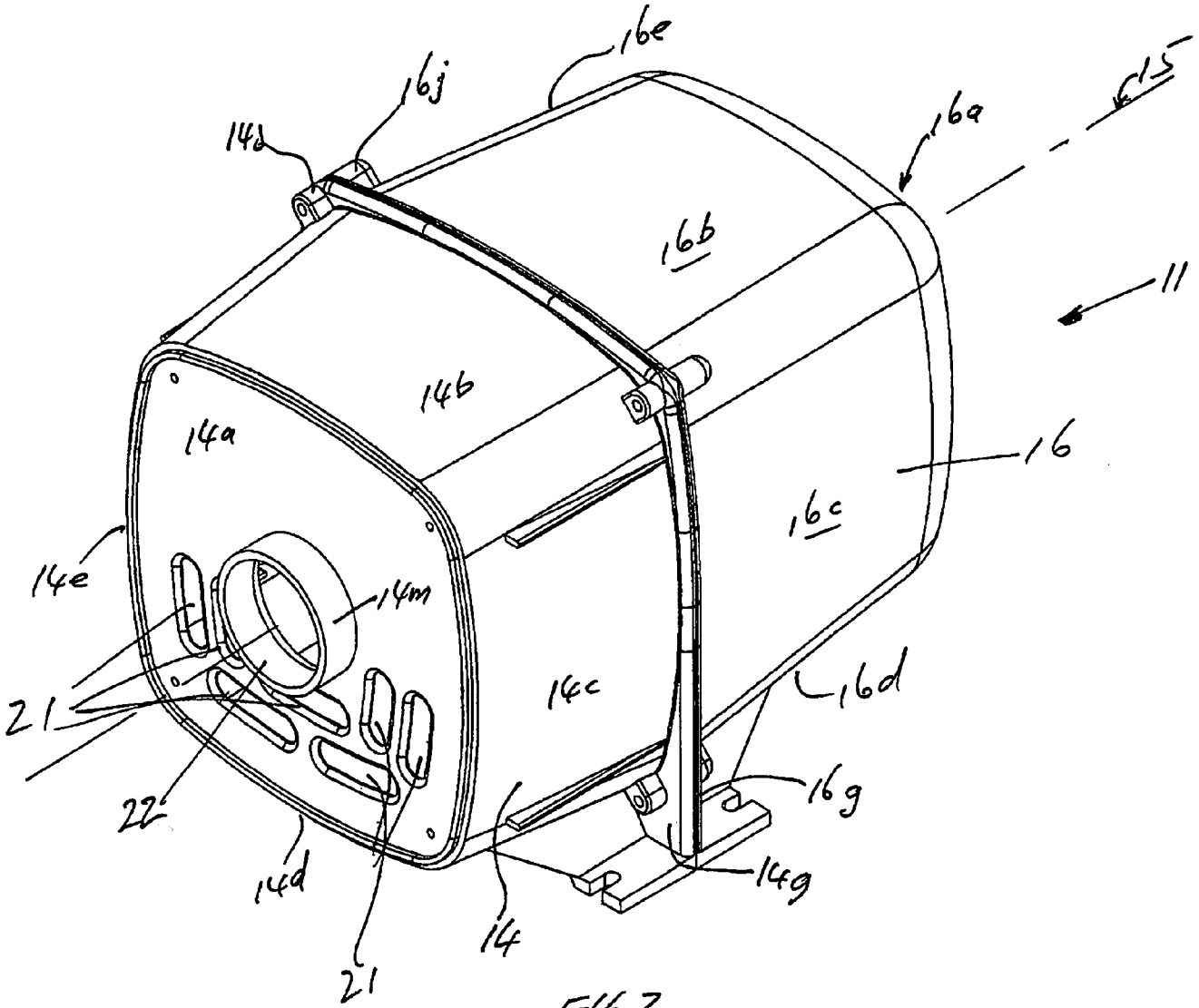
FIG. 2 is an isometric view of a blower unit of FIG. 1 with an end cover removed.
Figure 5:
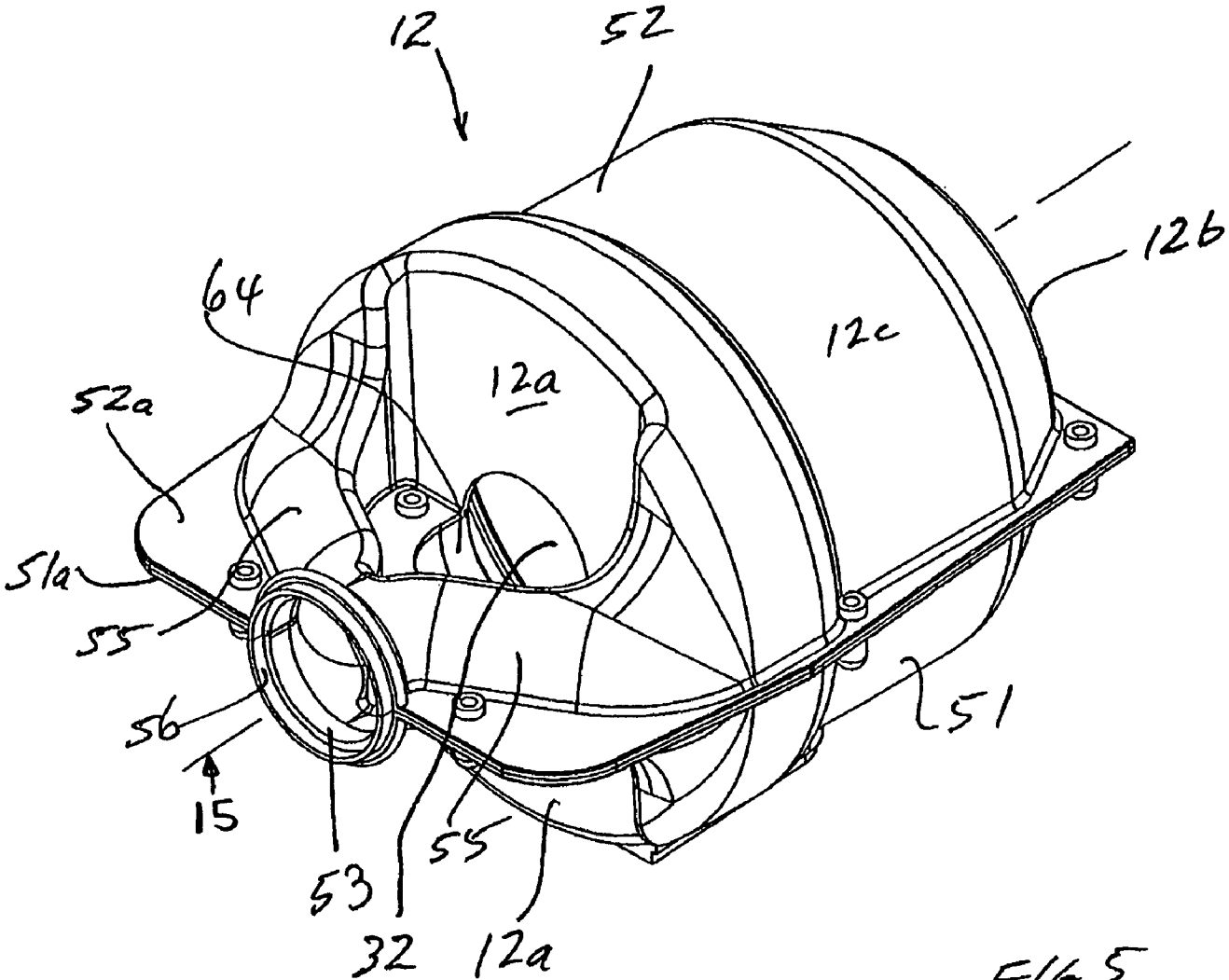
FIG. 5 is an isometric view of a shroud of a blower unit of FIG. 1.
Figure 6:
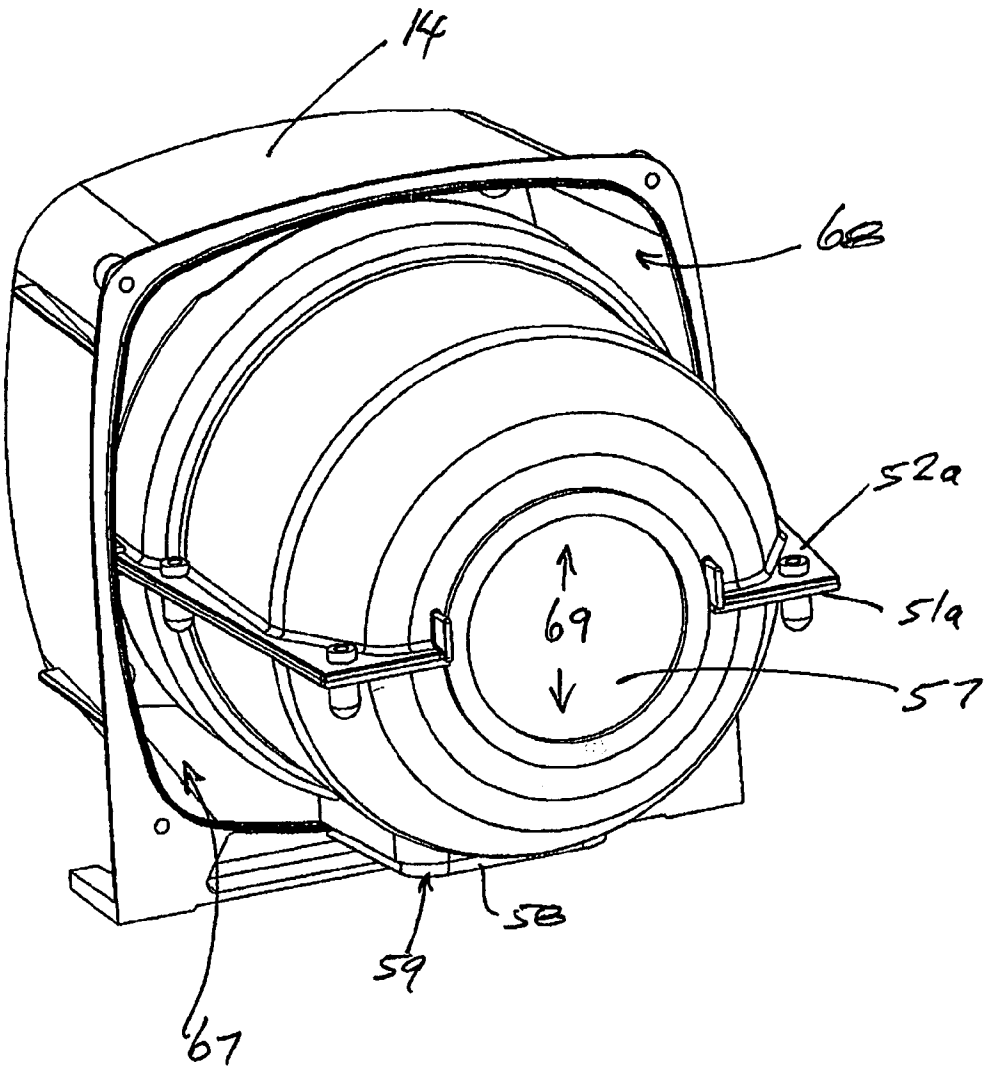
FIG. 6 is an isometric view of a housing half of FIG. 3 fitted to a shroud of FIG. 5.
Figure 8:
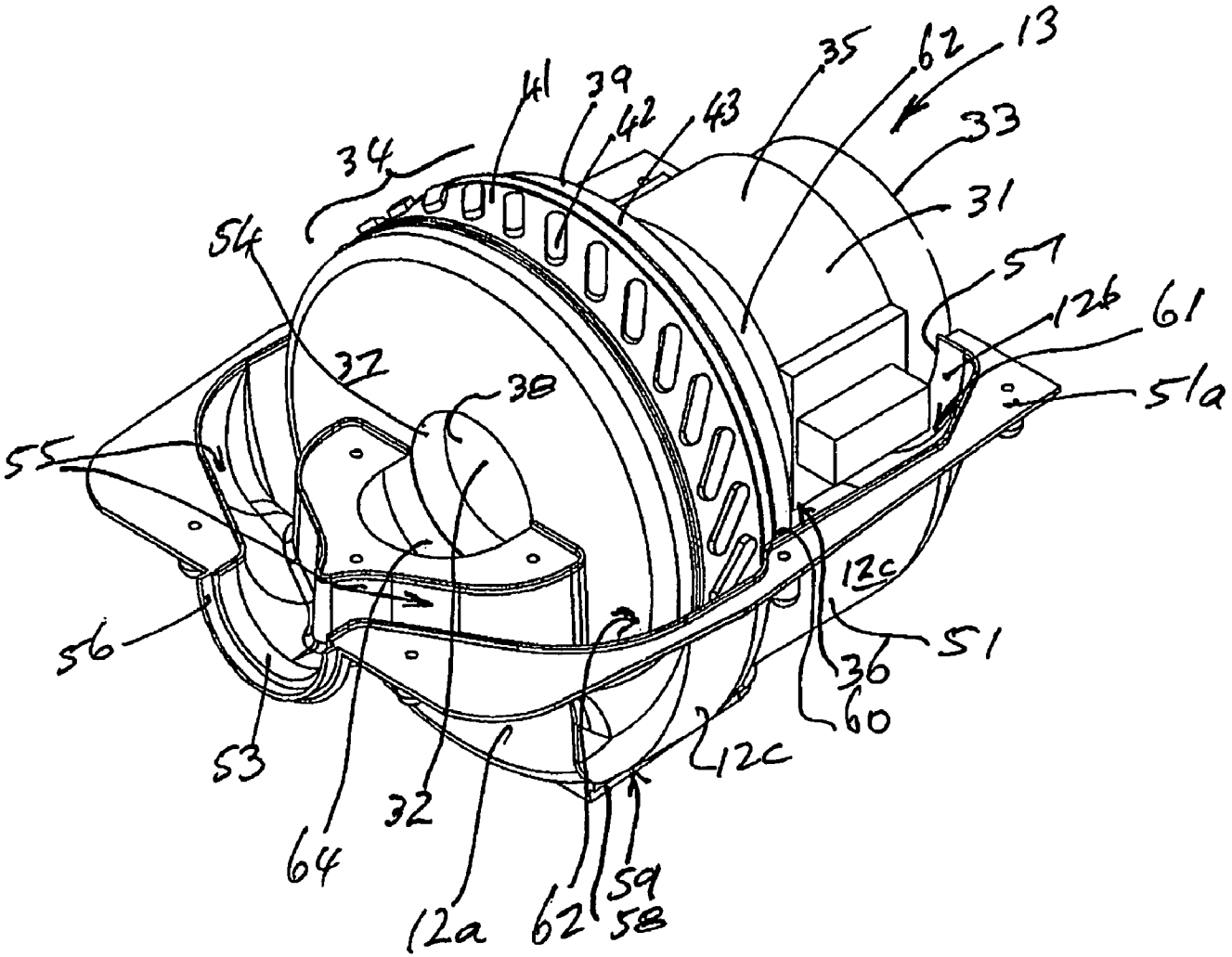
FIG. 8 is an isometric view of a close coupled fan unit fitted to a bottom half of a shroud of FIG. 5.
Figure 9:
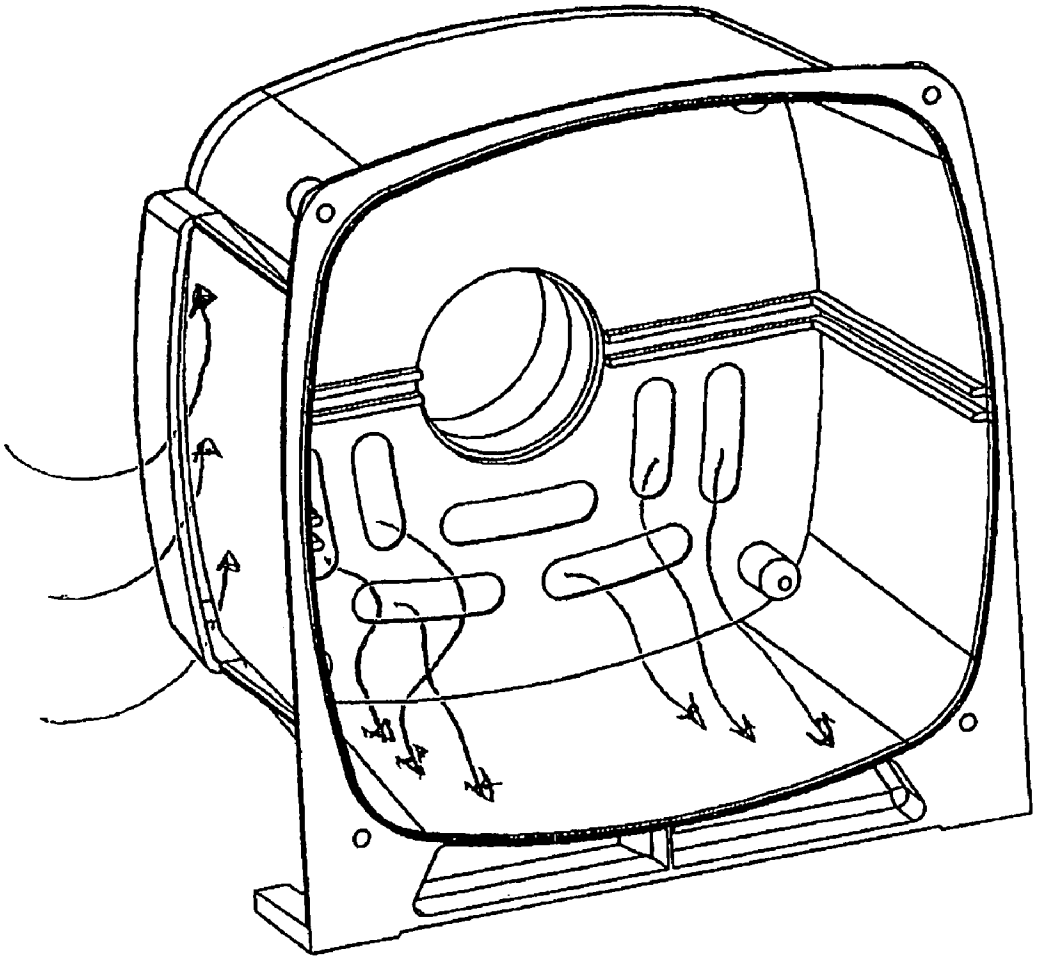
FIG. 9 is an isometric view of a first housing half disclosing air flow paths therethrough.
Figure 10:
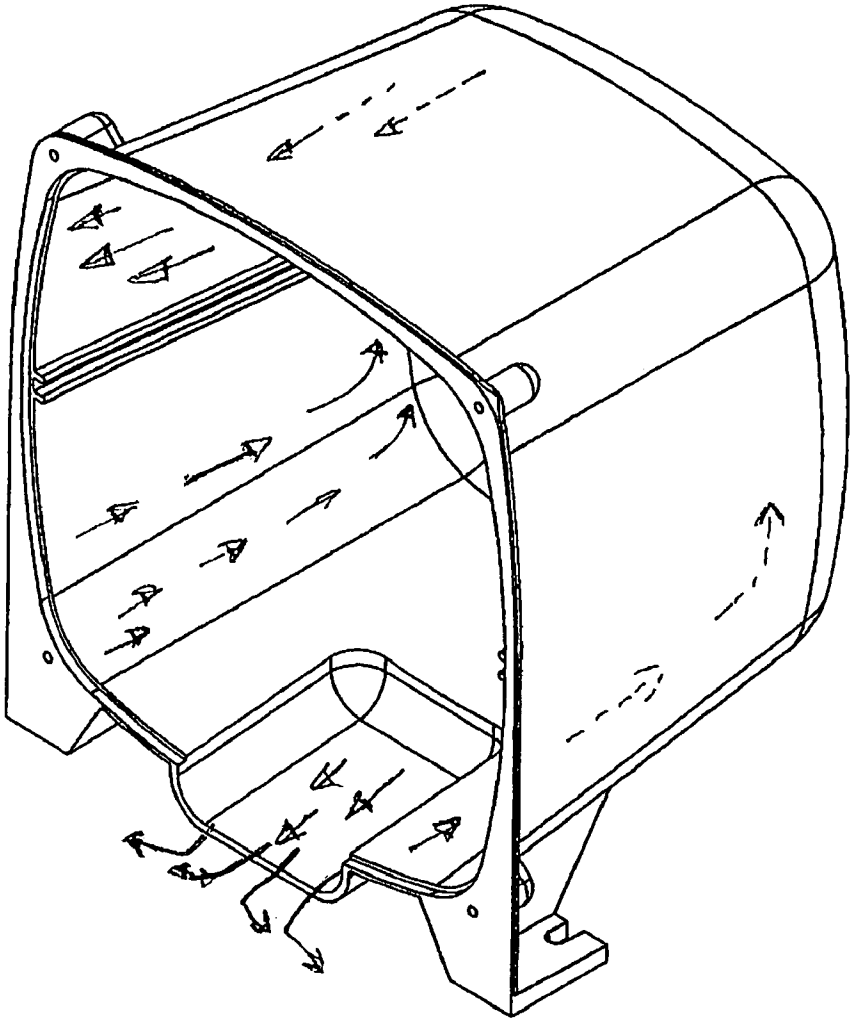
FIG. 10 is an isometric view of a second housing half disclosing air flow paths therethrough.
Figure 11:
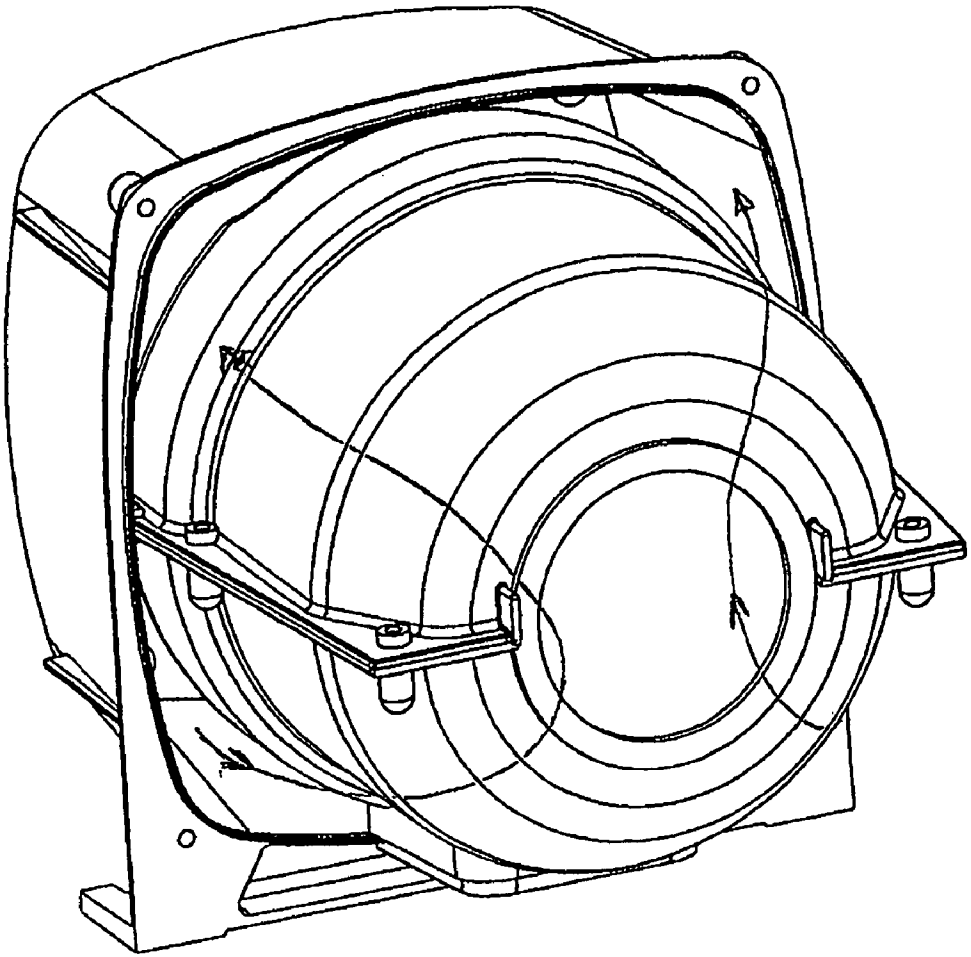
FIG. 11 is an isometric view of a shroud retain in a first housing half, disclosing air flow paths therethrough.
Figure 12:
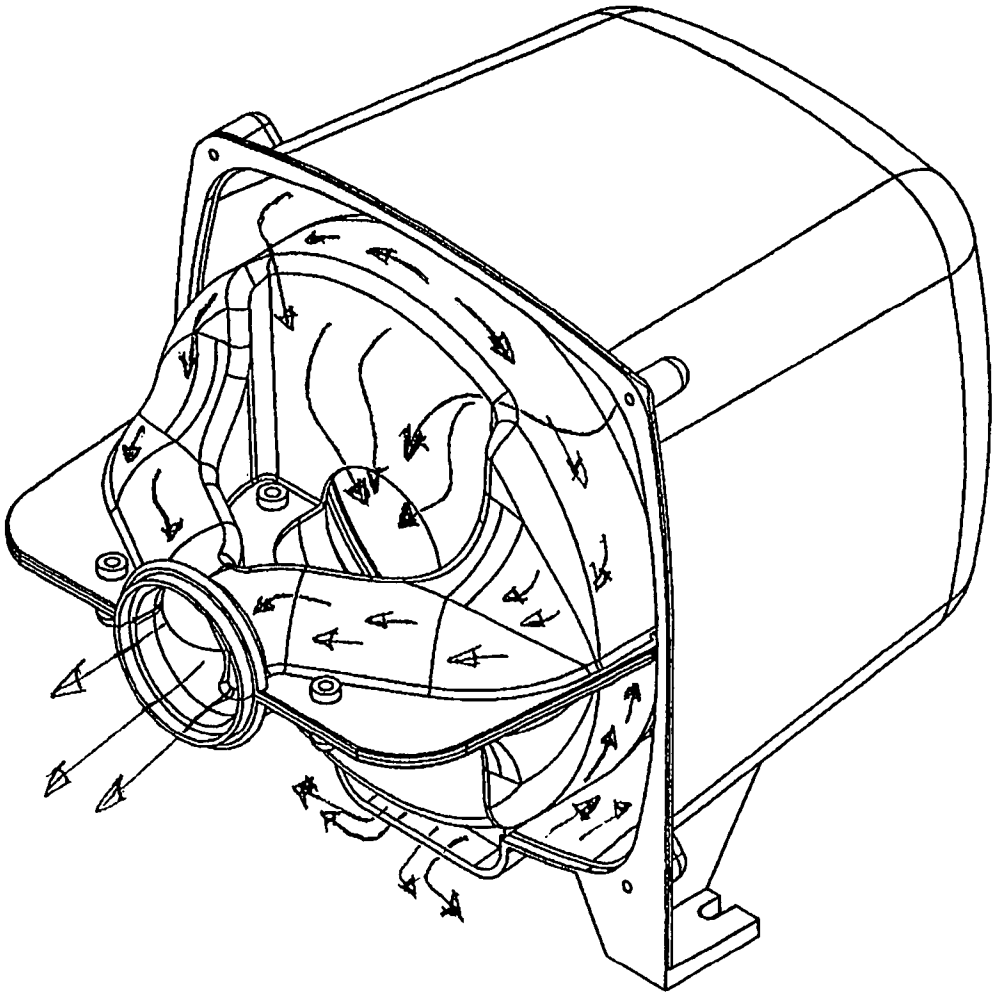
FIG. 12 is an isometric view of a shroud retain in a first housing half, disclosing air flow paths therethrough.

With reference now to the drawings, and particularly to FIG. 1, there is shown a blower unit 10. With reference to FIG. 2, the blower unit 10 includes three main components, a housing 11 as shown in FIG. 2, a shroud 12 as shown in FIG. 5 which is supported in the housing, and a close coupled fan unit 13 as shown in FIG. 8 which is supported in the shroud.

The housing 11 comprises a first housing half 14 and a complementary second housing half 16. The first housing half has an end wall 14*a* and four contiguous side walls 14*b*, 14*c*, 14*d* and 14*e* extending therefrom which terminate at a flange 14*g* extending about the side walls to form an opening 14*f*. An outlet spigot 14*m* extends outwardly from the end wall for connection to an air supply pipe for a spa bath or the like. Similarly, the second housing half has an end wall 16*a* and four contiguous side walls 16*b*, 16*c*, 16*d* and 16*e* extending therefrom which terminate at a flange 16g extending about the side walls to form an opening 16*f* which is adapted to align with the complementary opening 14*f* of the first housing half. Additionally, a locating spigot 14*h* extends from the flange 14*g* and is adapted to locate in a complementary recess 16*h* formed at the internal edge of the flange

16*g* about the opening of the second housing half. The two housing halves engage at the two flanges 14*g* and 16*g* with the spigot 14*h* locating in the recess 16*h* as can be ascertained from FIG. 2, and are secured together by screw fasteners which locate in the complementary lugs 14*j* and 16*j* provided on the respective corners of the side walls adjacent the flanges such that the housing halves together form the housing 11 which is generally elongate about longitudinal axis 15 and square in cross sectional shape along the axis. Suitably, each housing half includes a mounting foot half which together form a mounting foot 17 for mounting the unit to a suitable foundation such as a bench, floor or Wall.

The terms "top," "bottom," "upper," "lower," "forward," "rearward" and the like are used herein to describe various integers in their normal in-use position and are not intended to limit the invention to use in any particular orientation.

Figure 3:
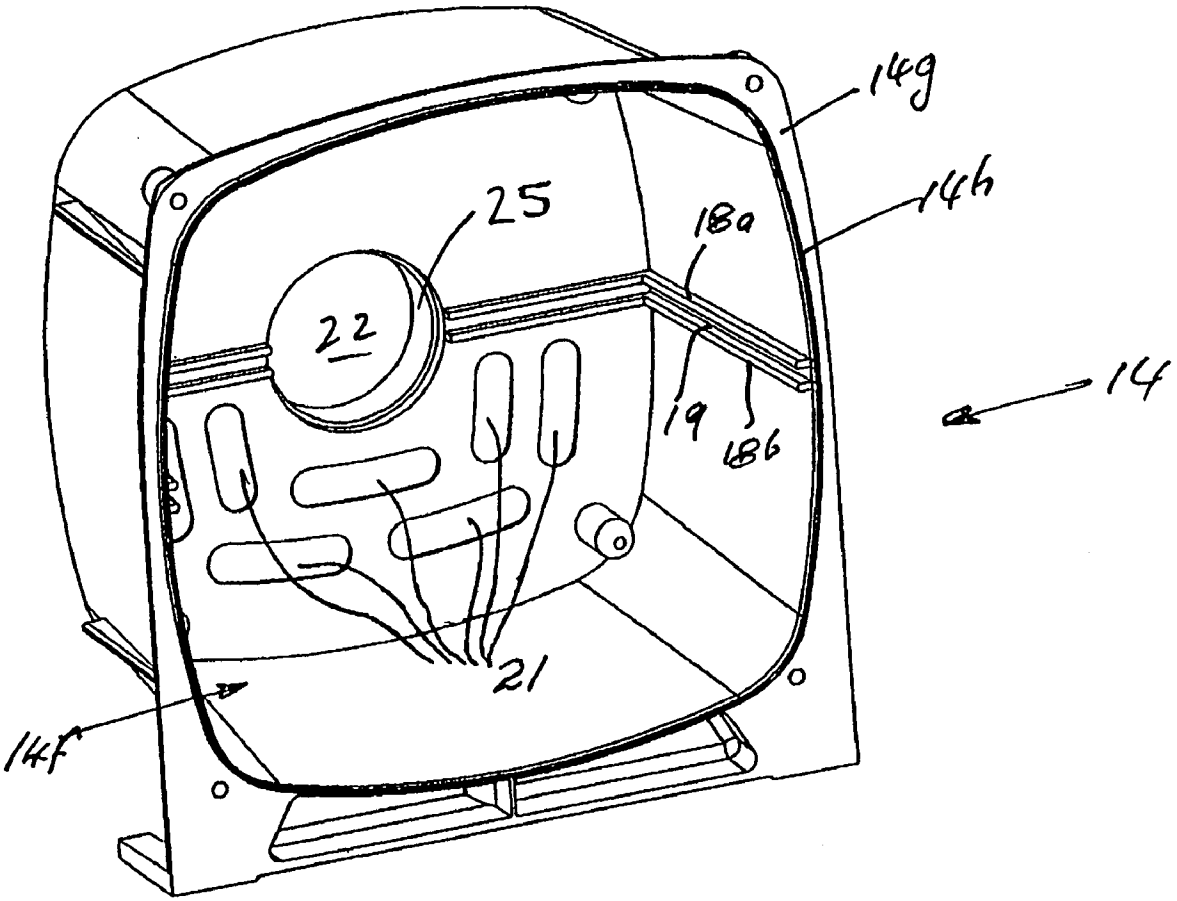
FIG. 3 is an isometric view of a first housing half of a blower unit of FIG. 1.
Figure 4:
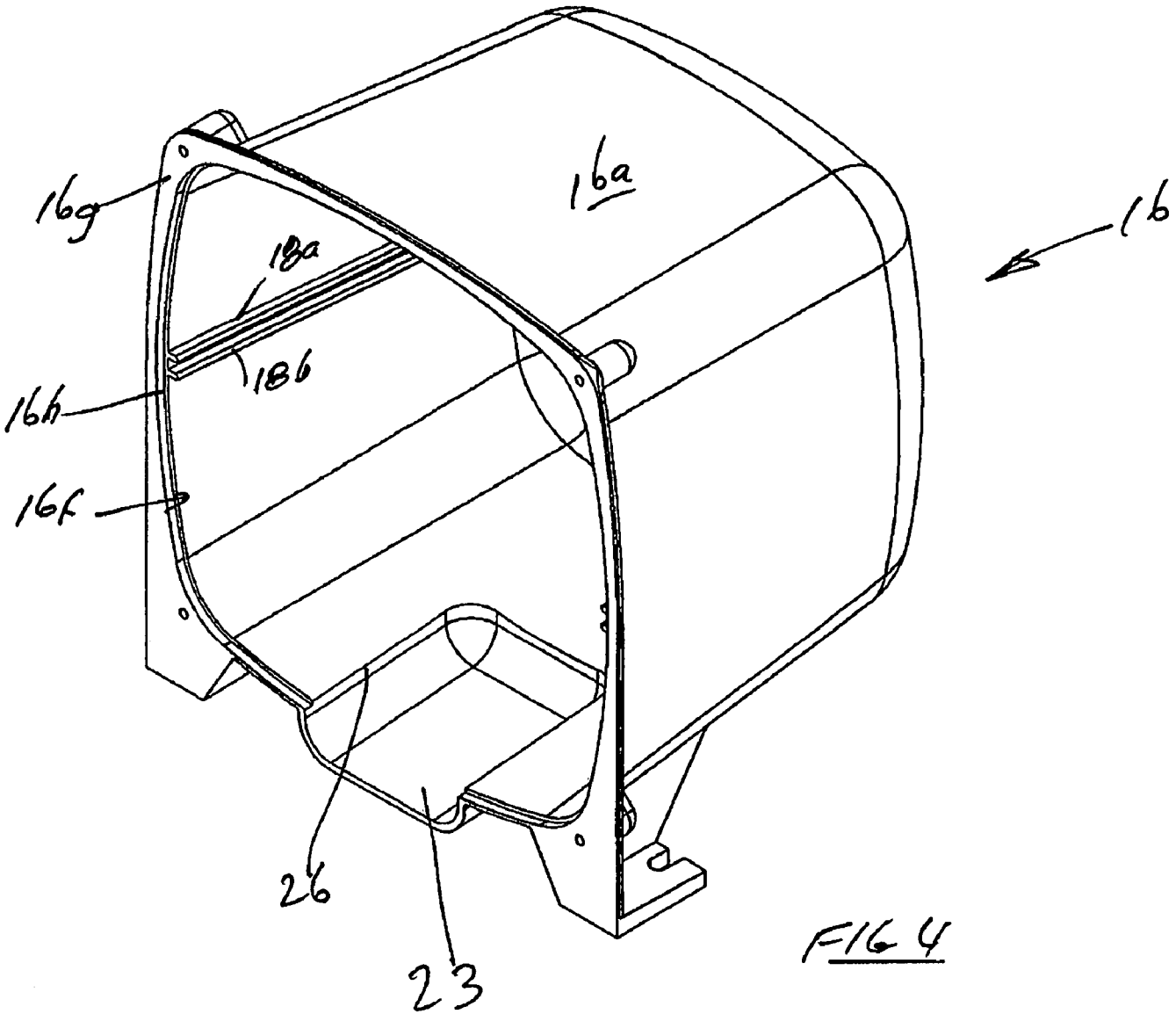
FIG. 4 is an isometric view of a second housing half of a blower unit of FIG. 1.

A pair of spaced apart ribs 18*a* and 18*b* extends along the inner face of both housing halves about mid-way up the side walls to provide a recess 19 therebetween as can be seen in FIGS. 3 and 4 for locating and supporting the shroud 12 as will be described later.

A plurality of fresh air inlet openings 21 are provided in the first half end wall 14*a* below the ribs 18*a* and 18*b* to provide a fresh air entry to the housing. Also, a feed air discharge outlet opening 22 is provided in the center of the end wall and is adapted to engage with a complementary spigot on the shroud as will be described later. A motor cooling air discharge outlet 23 is provided at the bottom of the second housing half and is adapted to engage with a complementary outlet spigot of the shroud as also will be described later.

Turning to FIG. 8, the close coupled fan unit 13 is of known type and includes a drive motor 31 having a feed air impeller 32 (not visible) mounted on the drive end of the motor shaft and a motor cooling air impeller 33 (not visible) mounted on the other end of the motor shaft within the end portion of the motor casing 35. The cooling air impeller 33 is adapted to force air through the motor to the outlets 36. The feed air impeller 32 is encased in a fan casing 34 which has a circular front wall 37 with a central feed inlet opening 38 to the inlet of the impeller, a rear wall 39 spaced from the front wall which is secured directly to the motor housing, and a cylindrical side wall 41 joining the front and rear walls to form the fan casing. A plurality of spaced apart apertures 42 are provided in the cylindrical wall and form a segmented circumferentially extending feed air outlet from the fan casing. The close coupled fan unit is mounted in the shroud to achieve the desired separation of motor cooling air and blower feed air and the desired direction of air flow, noise reduction and compactness. In other forms of the invention the fan casing could form part of the shroud 12.

The shroud 12 has a lower shroud half 51 and an upper shroud half 52 which are secured together as shown in FIG. 5 to form a generally cylindrical shroud having opposed first and second end walls 12*a* and 12*b* and a generally cylindrical side wall 12*c* extending therebetween and contiguous with the end walls. The first end wall is shaped to form tubular flow passages 55 which will be described more fully later, and which terminate in a spigot 56 which defines a feed air outlet 53. Between the flow passages another opening 54 is provided in the first end wall to provide a feed air inlet to the inlet of the impeller. The feed air inlet is close to the feed air outlet and both are aligned with the longitudinal axis 15 of the shroud. At the other end of the shroud, an opening 57 is provided to form a cooling air inlet to the motor while the side wall 12*c* is shaped to form a cooling air discharge passage 58 which terminates in a spigot defining another opening 59 in the lower shroud half to form a motor cooling air outlet.

As can be seen in FIG. 8, a circular flange 60 extends about the inner face of the casing, half on each casing half, to provide a shoulder against which a complementary shoulder and spigot 43 provided on the rear wall 39 of the fan casing engages. Suitably, the flange locates the close coupled fan unit in the shroud and the shroud and the close coupled fan unit co-operate to define a motor chamber 61 and a fan chamber 62. It will be seen that while flange 60 supports the close coupled fan unit at the feed fan end, the end portion of the motor casing 35 extends through the cooling air inlet opening 57 and is supported by end wall 12*b* of the shroud.

In the fan chamber, the side wall 12*c* of the shroud extends about but is spaced from the feed air outlets 42 of the fan casing and forms a guide chamber thereabout which is contiguous with the two spaced apart passages 55 which direct feed air from the impeller to the outlet opening 53. It will also be seen that the side wall 12*c* in the motor chamber portion of the shroud is adapted to guide the cooling air discharged from the motor through motor outlets 36 to the motor cooling air outlet opening 59 in the bottom of the shroud.

The first end wall 12*a* of the shroud abuts the front wall 37 of the fan casing and has an opening 64 therein which aligns with the opening 38 of the fan casing to allow air to flow into the feed air impeller 32. The lower half 51 of the shroud has a quatrospherical wall portion formed therein which is adapted to guide air into the opening 64.

Figure 7:
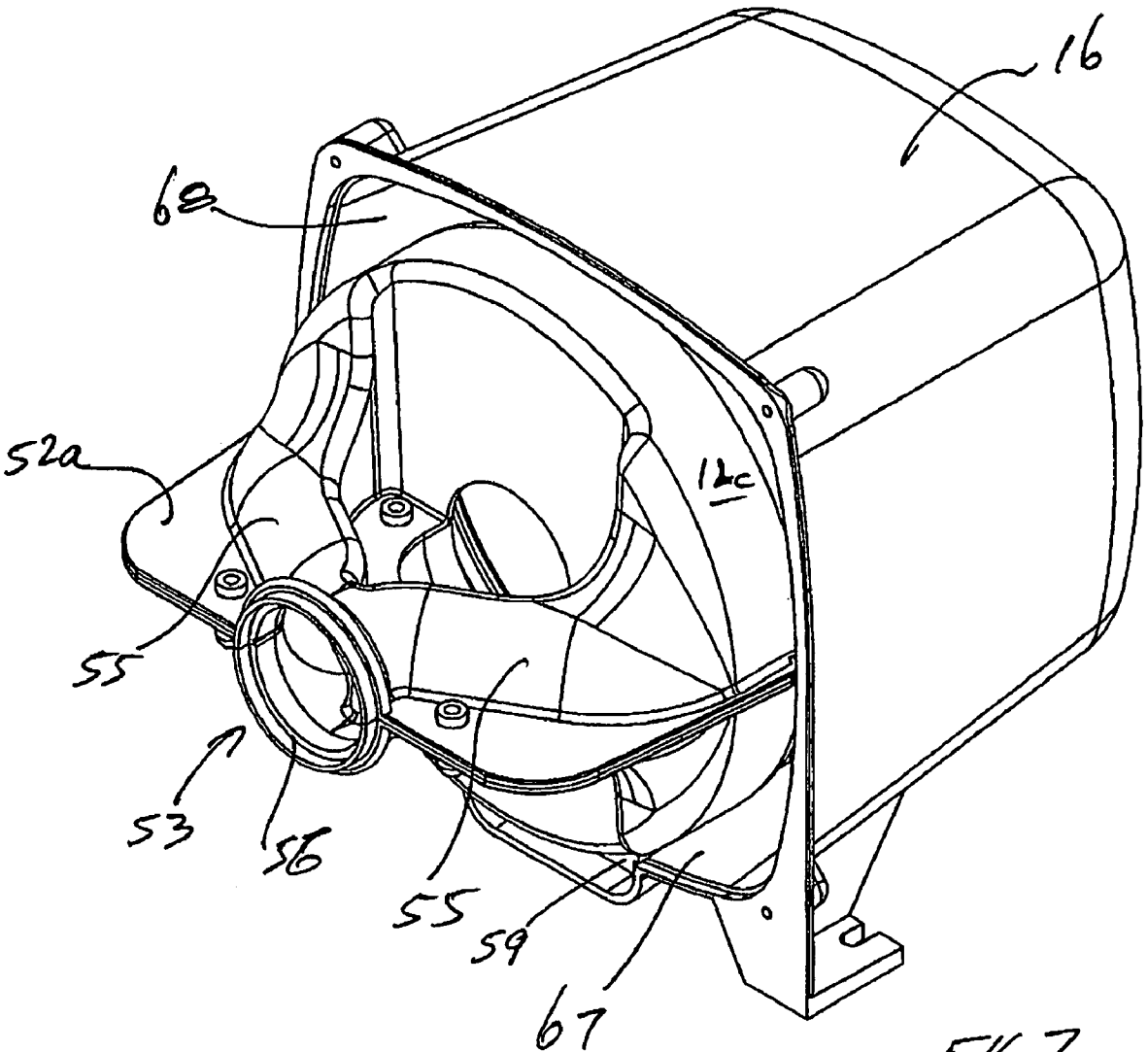
FIG. 7 is an isometric view of a housing half of FIG. 4 fitted to a shroud of FIG. 5.

It will be seen that the two shroud halves have matching outwardly directed flanges 51*a* and 52*a* which are adapted to abut each other and to be secured together by screw fasteners. In order to ensure satisfactory sealing and correct alignment of the two halves, the lower half 51 has a spigot extending from its flange which is arranged to engage in a complementary recess provided in the upper half flange. As mentioned earlier, the shroud is supported in the housing 11 and for this purpose, the flanges 51*a* and 52*a* together are adapted to engage in the recess 19 between the spaced apart ribs 18*a* and 18*b* around the inner face of the housing. The mounting arrangement results in the shroud and the housing cooperating to define a lower chamber 67 and an upper chamber 68 as shown in FIG. 7 which are in fluid communication via a passage 69 between the end wall 16*a* of the housing and the end of the motor casing 35.

The outlet spigot 56 of the shroud is adapted to engage in a complementary recess 25 provided in the housing first half end wall 14*a* about the outlet opening 22 in order to achieve correct alignment. Similarly, the cooling air outlet spigot 58 of the shroud, is adapted to engage with a complementary recess 26 provided in the lower wall 16*d* about the opening 23 as can be seen in FIG. 4.

A cover plate 71 is secured to the end 14*a* of the first housing half in order to shield the fresh air inlet openings 21 and to inhibit noise emissions. The cover has an end wall 71*a* and four contiguous side walls 71*b*, 71*c*, 71*d* and 71*e* extending therefrom and adapted to engage with the corresponding side walls of the first housing half. Suitably, the end wall 71*a* of the cover plate is spaced from the end wall 14*a* of the first housing half and the opposite side walls 71*c* and 71*e* are spaced from the corresponding side walls 14*c* and 14*e* to provide fresh air flow passages 72 to the fresh air inlet openings 21. Also, a threaded pipe fitting 73 is fitted to the outlet spigot 14*m* for connection to a supply pipe to a spa or bath.

In use, air is drawn in to the bottom half of the housing 11 through flow passages 72 and fresh air inlet openings 21 by the feed impeller 32 and to a lesser extent the motor cooling air impeller 33. It will be appreciated that the air flows through the lower chamber 67 effectively surrounding the bottom half of the shroud and enters the upper chamber 68 via a passage 69 between the end wall formed by flanges 51*a* and 52*a* of the shroud and the end wall 16*a* of the housing. As the air flows through that passage, some is drawn into the electric motor by the motor cooling air impeller but most is drawn into the feed air inlet 38 by the feed impeller 32. In order to reach the feed air impeller, the air must flow across and effectively surround the upper half of the shroud after entering through the passage 69. The air discharged by the feed impeller is guided to the feed air outlet 53 by the fan chamber and passages 55 where it can then be discharged to a spa bath supply pipe or the like while air which flows through the motor is directed to the motor cooling air discharge opening 23 of the housing. It is believed that the arrangement of the fresh air inlet openings 21 is such as to create a swirling action in the lower chamber 68 which helps cool the shroud and the enclosed motor.

It will be appreciated from the foregoing description and from FIGS. 9 to 12 that the paths to the feed fan inlet from the fresh air inlet passages is tortuous to noise emissions but efficient for air flow. It is believed that the housing and the shroud can be produced in a softer plastics material than generally found on blower units and that such a soft material is beneficial in noise attenuation. The blower unit 10 should not be limited to use with spas only, but should include use in any appropriate application.

The foregoing description has been given by way of illustrative example of the invention, and many modifications and variations which will be apparent to persons skilled in the art may be made without departing from the spirit and scope of the invention as defined in the appended claims.

I claim:

1. A method of providing a cooled blower unit, comprising the steps of:

rotating a feed air impeller in a casing, said casing having a casing inlet and at least one aperture outlet;

rotating a cooling air impeller at a rear of a motor and said feed air impeller at a front thereof;

providing a shroud having a chamber adjacent said casing, said motor being retained in said shroud, providing at least one passage from said chamber to a shroud outlet in said shroud;

retaining said shroud in a housing, forming at least one air opening and a housing outlet in said housing, said housing outlet receiving said shroud outlet;

rotating said cooling air impeller to draw inlet air through said at least one air opening, said inlet air flowing between said motor and said shroud, said inlet air flowing out of said shroud and said housing; and rotating said feed air impeller to draw said inlet air between said shroud and said housing into said casing inlet, said feed air impeller forcing air through said at least one aperture outlet to said housing outlet.

2. The method of providing a cooled blower unit of claim 1, further comprising the step of:

providing said housing with a first housing half and a second housing half, said at least one air opening and said housing outlet being formed in a front of said first housing half.

3. The method of providing a cooled blower unit of claim 2, further comprising the step of:

forming a recess in a bottom of said second housing half.

4. The method of providing a cooled blower unit of claim 3, further comprising the step of:

providing said shroud with a first shroud half and an second shroud half, forming a discharge passage in said first shroud half, said discharge passage communicating with said recess to exhaust said inlet air from between said motor and said shroud.

5. The method of providing a cooled blower unit of claim 1, further comprising the step of:

attaching a portion of said casing to said motor.

6. A method of provided a cooled blower unit, comprising the steps of:

rotating a feed air impeller at one end of a motor and a cooling air impeller at the other end of said motor;

containing said feed air impeller in a fan casing, forming a plurality of apertures through a cylindrical wall of said fan casing, forming a feed inlet opening through a front wall of said fan casing;

containing said fan casing and said motor in a shroud, said shroud including a guide chamber adjacent said plurality of apertures, forming at least one tubular passage in said shroud that communicates with said guide chamber, said at least one tubular passage communicating with a feed air outlet in a front of said shroud;

retaining said shroud in a housing, forming at least one air inlet opening and an air discharge outlet in said housing, said air discharge outlet receiving said feed air outlet;

rotating said cooling air impeller to draw inlet air through said at least one air inlet opening, said inlet air flowing between said motor and said shroud, said inlet air flowing out of said shroud and said housing;

rotating said feed air impeller to draw said inlet air between said shroud and said housing into said feed inlet opening, said air impeller forcing air through said plurality of apertures and said at least one tubular passage to said air discharge outlet.

7. The method of providing a cooled blower unit of claim 6, further comprising the step of:

providing said housing with a first housing half and a second housing half, said at least one air inlet opening and said air discharge outlet being formed in a front of said first housing half.

8. The method of providing a cooled blower unit of claim 7, further comprising the step of:

forming a recess in a bottom of said second housing half.

9. The method of providing a cooled blower unit of claim 8, further comprising the step of:

providing said shroud with a first shroud half and an second shroud half, forming a discharge passage in said first shroud half, said discharge passage communicating with said recess to exhaust said inlet air from between said motor and said shroud.

10. The method of providing a cooled blower unit of claim 6, further comprising the step of:

attaching a portion of said fan casing to said motor.

11. A method of providing a cooled blower unit, comprising the steps of:

rotating a feed air impeller at one end of a motor and a cooling air impeller at the other end of said motor;

containing said feed air impeller in a fan casing, forming a plurality of apertures through a cylindrical wall of said fan casing, forming a feed inlet opening through a front wall of said fan casing;

containing said fan casing and said motor in between a first shroud half and an second shroud half, said first and second shroud halves including a guide chamber adjacent said plurality of apertures, forming at least one tubular passage in at least one of said first and second shroud halves that communicates with said guide chamber, said at least one tubular passage communicating with a feed air outlet in a front of said first and second shroud halves;

retaining said first and second shroud halves in a first housing half and a second housing half, forming at least one air inlet opening and an air discharge outlet in a front of said first housing half, said air discharge outlet receiving said feed air outlet;

rotating said cooling air impeller to draw inlet air through said at least one air inlet opening, said inlet air flowing between said motor and said first and second shroud halves, said inlet air flowing out of said first and second shroud halves and said first and second housing halves;

rotating said feed air impeller to draw said inlet air between said first and second shroud halves and said first and second housing halves into said feed inlet opening, said air impeller forcing air through said plurality of apertures and said at least one tubular passage to said air discharge outlet.

12. The method of providing a cooled blower unit of claim 11, further comprising the step of:

forming a recess in a bottom of said second housing half.

13. The method of providing a cooled blower unit of claim 12, further comprising the step of:

forming a discharge passage in said first shroud half, said discharge passage communicating with said recess to exhaust said inlet air from between said motor and said shroud.

14. The method of providing a cooled blower unit of claim 11, further comprising the step of:

attaching a portion of said fan casing to said motor.

15. A method of providing a cooled blower unit, comprising the steps of:

rotating a motor having a shaft, attaching a feed air impeller to one end of said shaft and a cooling air impeller to the other end of said shaft;

enclosing said motor in a shroud, said shroud having an air inlet and an air outlet, said feed air impeller being adjacent to said air inlet;

retaining said shroud in a housing, forming at least one air inlet opening and at least one air outlet opening in said housing, said at least one air outlet opening communicating with said air outlet;

rotating said cooling air impeller to draw inlet air through said at least one air inlet opening, said inlet air flowing between said motor and said shroud; and rotating said feed air impeller to force air through said at least one air outlet opening.

16. The method of providing a cooled blower unit of claim 15, further comprising the step of:

rotating said feed air impeller in a casing, said casing having a casing inlet and at least one aperture outlet.

17. The method of providing a cooled blower unit of claim 16, further comprising the step of:

rotating said feed air impeller to draw said inlet air between said shroud and said housing into said casing inlet, said feed air impeller forcing air through said at least one aperture outlet to said at least one outlet opening.

18. The method of providing a cooled blower unit of claim 15, further comprising the step of:

providing said housing with a first housing half and a second housing half, said at least one air inlet opening and said at least one air outlet opening being formed in a front of said first housing half.

19. The method of providing a cooled blower unit of claim 18, further comprising the step of:

forming a recess in a bottom of said second housing half.

20. The method of providing a cooled blower unit of claim 19, further comprising the step of:

providing said shroud with a first shroud half and an second shroud half, forming a discharge passage in said first shroud half, said discharge passage communicating with said recess to exhaust said inlet air from between said motor and said shroud.

21. The method of providing a cooled blower unit of claim 15, further comprising the step of:

attaching a portion of said casing to said motor.

* * * * *